US011225078B2

(12) United States Patent
Tatsuta et al.

(10) Patent No.: US 11,225,078 B2
(45) Date of Patent: Jan. 18, 2022

(54) LIQUID EJECTING UNIT AND LIQUID EJECTING APPARATUS

(71) Applicant: SEIKO EPSON CORPORATION, Tokyo (JP)

(72) Inventors: Daiki Tatsuta, Matsumoto (JP); Osamu Murayama, Yamagata-mura (JP); Junya Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/821,387

(22) Filed: Mar. 17, 2020

(65) Prior Publication Data

US 2020/0298568 A1 Sep. 24, 2020

(30) Foreign Application Priority Data

Mar. 20, 2019 (JP) ..... JP2019-052355

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2/1433
See application file for complete search history.

(56) References Cited

U.S. PATENT DOCUMENTS

2011/0261103 A1 10/2011 Saga et al.
2012/0038709 A1* 2/2012 Owaki ..... B41J 2/17513 347/40
2012/0293585 A1 11/2012 Hanagami et al.
2016/0271948 A1* 9/2016 Hamaguchi ..... B41J 2/14233
2017/0232741 A1 8/2017 Kikuchi et al.
2018/0178511 A1 6/2018 Kashimura
2018/0264816 A1 9/2018 Tomimatsu et al.

FOREIGN PATENT DOCUMENTS

JP 2007-105926 4/2007
JP 2016-007791 1/2016
JP 2017-154488 9/2017

* cited by examiner

*Primary Examiner* — Jason S Uhlenhake
(74) *Attorney, Agent, or Firm* — Workman Nydegger

(57) ABSTRACT

A liquid ejecting unit includes: a liquid ejecting head configured to eject a liquid; a flow channel member that is attached to the liquid ejecting head and that supplies the liquid to the liquid ejecting head; and an electric coupling member configured to supply a signal to the liquid ejecting head, in which the electric coupling member has a first electric coupling portion, the liquid ejecting head has a second electric coupling portion electrically coupled to the first electric coupling portion, and the flow channel member restricts the electric coupling member from moving in a direction in which the first electric coupling portion is removed from the second electric coupling portion.

15 Claims, 12 Drawing Sheets

LIQUID EJECTING UNIT AND LIQUID EJECTING APPARATUS

The present application is based on, and claims priority from JP Application Serial Number 2019-052355, filed Mar. 20, 2019, the disclosure of which is hereby incorporated by reference herein in its entirety.

BACKGROUND

1. Technical Field

The present disclosure relates to a liquid ejecting unit and a liquid ejecting apparatus.

2. Related Art

A liquid ejecting apparatus that ejects a liquid such as an ink from a nozzle has been proposed in the related art. For example, JP-A-2017-154488 discloses a liquid ejecting apparatus including a head body portion that ejects a liquid, a flow channel component that supplies the liquid to the head body portion, and a wiring member that supplies various signals to the head body portion. A connector of the wiring member and a connector of the head body portion are coupled to each other, and both the connectors are protected by cover members.

In the technology of JP-A-2017-154488, when the flow channel component is removed from the head body portion, the liquid dripping from the flow channel component may adhere to the connector of the head body portion.

SUMMARY

To solve the above-described problems, a liquid ejecting unit according to an exemplary embodiment of the present disclosure includes: a liquid ejecting head that ejects a liquid; a flow channel member that is attached to the liquid ejecting head and supplies the liquid to the liquid ejecting head; and an electric coupling member for supplying a signal to the liquid ejecting head, in which the electric coupling member has a first electric coupling portion, the liquid ejecting head has a second electric coupling portion electrically coupled to the first electric coupling portion, and the flow channel member restricts the electric coupling member from moving in a direction in which the first electric coupling portion is removed from the second electric coupling portion.

A liquid ejecting unit according to another exemplary embodiment of the present disclosure includes: a liquid ejecting head that ejects a liquid; a flow channel member that is attached to the liquid ejecting head and supplies the liquid to the liquid ejecting head; and an electric coupling member for supplying a signal to the liquid ejecting head, in which the electric coupling member has a first electric coupling portion, the liquid ejecting head has a second electric coupling portion electrically coupled to the first electric coupling portion, and the electric coupling member is located between the flow channel member and the ejecting head in a direction in which the first electric coupling portion is removed from the second electric coupling portion.

A liquid ejecting unit according to yet another exemplary embodiment of the present disclosure includes: a liquid ejecting head that ejects a liquid; a flow channel member that is attached to the liquid ejecting head and supplies the liquid to the liquid ejecting head; and an electric coupling member for supplying a signal to the liquid ejecting head, in which the electric coupling member has a first electric coupling portion, the liquid ejecting head has a second electric coupling portion electrically coupled to the first electric coupling portion, and coupling between the first electric coupling portion and the second electric coupling portion is not released in a state in which the flow channel member and the liquid ejecting head are coupled to each other.

DESCRIPTION OF EXEMPLARY EMBODIMENTS

A. First Embodiment

Figure 1:
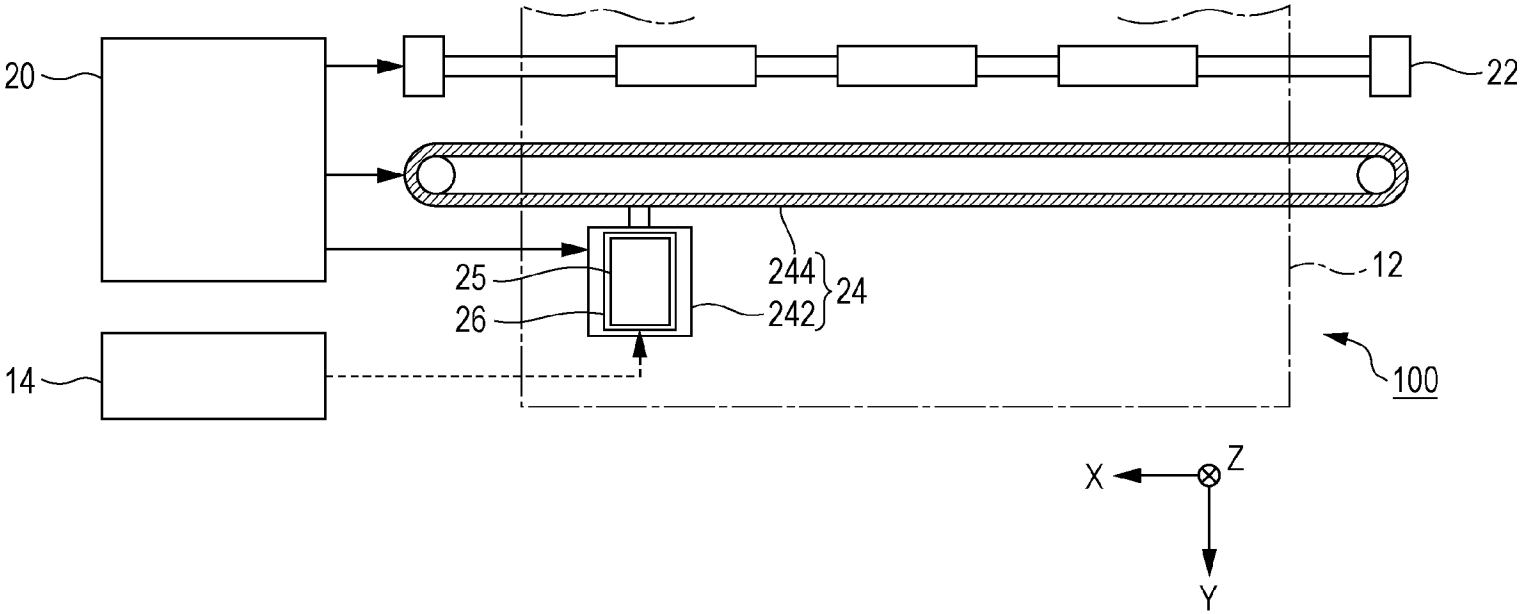
FIG. 1 is a diagram of a liquid ejecting apparatus according to a first embodiment.

FIG. 1 is a diagram illustrating a liquid ejecting apparatus 100 according to a first embodiment. The liquid ejecting apparatus 100 according to the first embodiment is an ink jet recording apparatus that ejects ink, which is an example of a liquid, onto a medium 12. Although the medium 12 is typically a recording paper sheet, a recording target made of a predetermined material such as a resin film and a fabric is used as the medium 12. As illustrated in FIG. 1, the liquid ejecting apparatus 100 is provided with a liquid container 14 that stores the ink. For example, a cartridge which can be attached to and detached from the liquid ejecting apparatus 100, a bag-like ink pack formed of a flexible film, or an ink tank which can be replenished with the ink is used as the liquid container 14.

As illustrated in FIG. 1, the liquid ejecting apparatus 100 includes a control unit 20, a transport mechanism 22, a movement mechanism 24, a flow channel member 25, and a liquid ejecting head 26. The control unit 20 includes a processing circuit such as a central processing unit (CPU) and a field programmable gate array (FPGA) and a storage circuit such as a semiconductor memory, and integrally controls each component of the liquid ejecting apparatus 100. The control unit 20 is an example of a controller. The transport mechanism 22 transports the medium 12 along a Y axis under a control of the control unit 20.

The movement mechanism 24 causes the flow channel member 25 and the liquid ejecting head 26 to reciprocate along the X axis under the control of the control unit 20. The X axis intersects the Y axis along which the medium 12 is transported. For example, the X axis and the Y axis are perpendicular to each other. The movement mechanism 24 according to the first embodiment includes a substantially box-shaped carriage 242 that stores the flow channel member 25 and the liquid ejecting head 26 and a transport belt 244 to which the carriage 242 is fixed. A configuration in which a plurality of the liquid ejecting heads 26 and the flow channel member 25 are mounted on the carriage 242 or a configuration in which the liquid container 14 is mounted on the carriage 242 together with the liquid ejecting head 26 and the flow channel member 25 may be employed.

The flow channel member 25 is a structure for supplying the ink from the liquid container 14 to the liquid ejecting head 26. For example, the ink is supplied from the liquid container 14 to the flow channel member 25 via a tube. For example, in a configuration in which the liquid container 14 is mounted on the carriage 242 together with the flow channel member 25, the liquid container 14 may be directly coupled to the flow channel member 25. A flow channel for supplying the ink to the liquid ejecting head 26 is formed in the flow channel member 25. The flow channel member 25 is attached to the liquid ejecting head 26. The liquid ejecting head 26 ejects the ink supplied from the flow channel member 25. In detail, the liquid ejecting head 26 ejects the ink supplied from the liquid container 14 to the medium 12 from a plurality of nozzles under the control of the control unit 20. Each liquid ejecting head 26 ejects the ink to the medium 12 together with the transportation of the medium 12 by the transport mechanism 22 and the repeated reciprocation of the carriage 242, so that a desired image is formed on the surface of the medium 12. In the following description, an axis that is perpendicular to the X-Y plane is thereinafter referred to as a Z axis. The Z axis is typically a vertical line.

Figure 2:
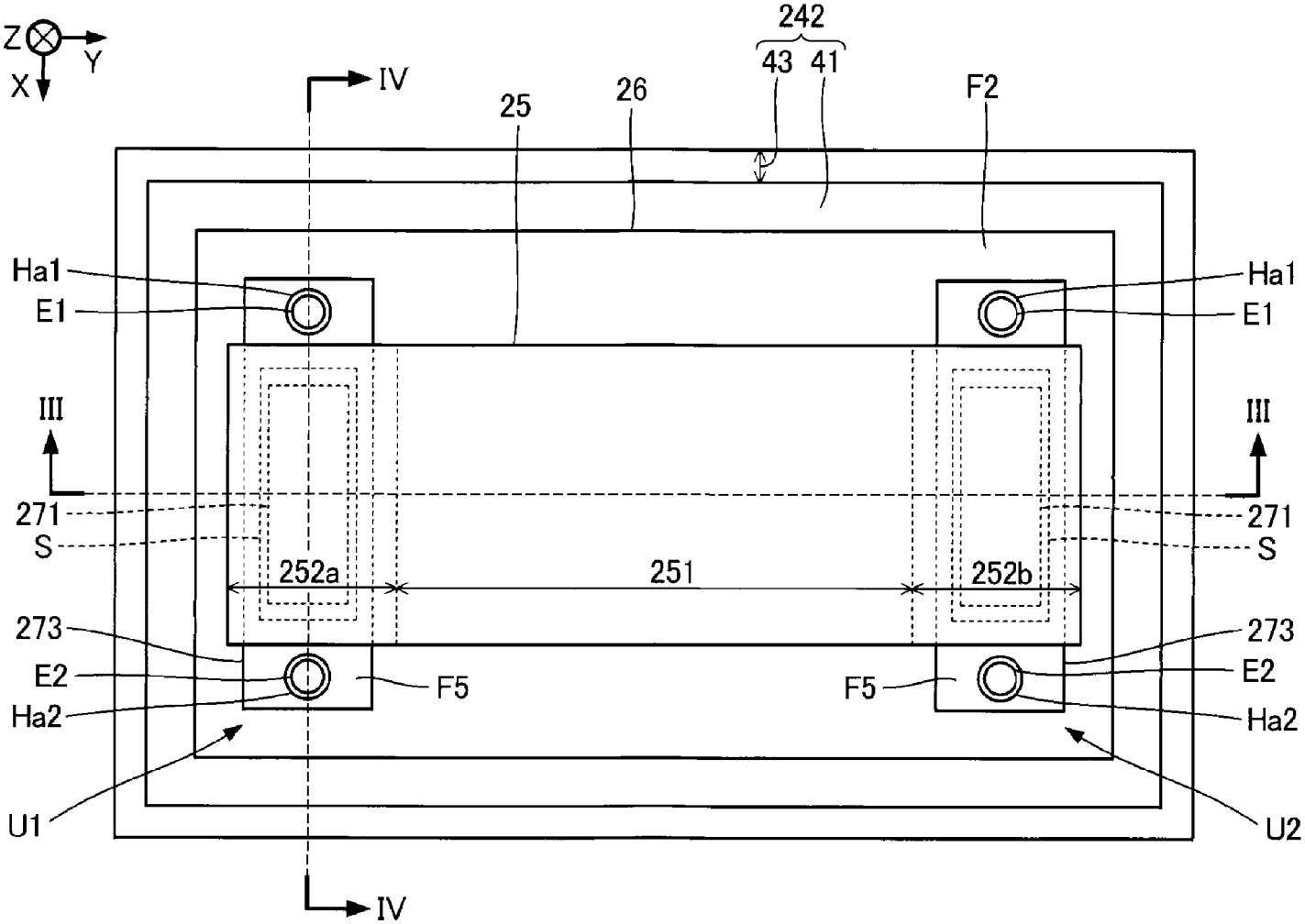
FIG. 2 is a plan view of a liquid ejecting head and a flow channel member.
Figure 3:
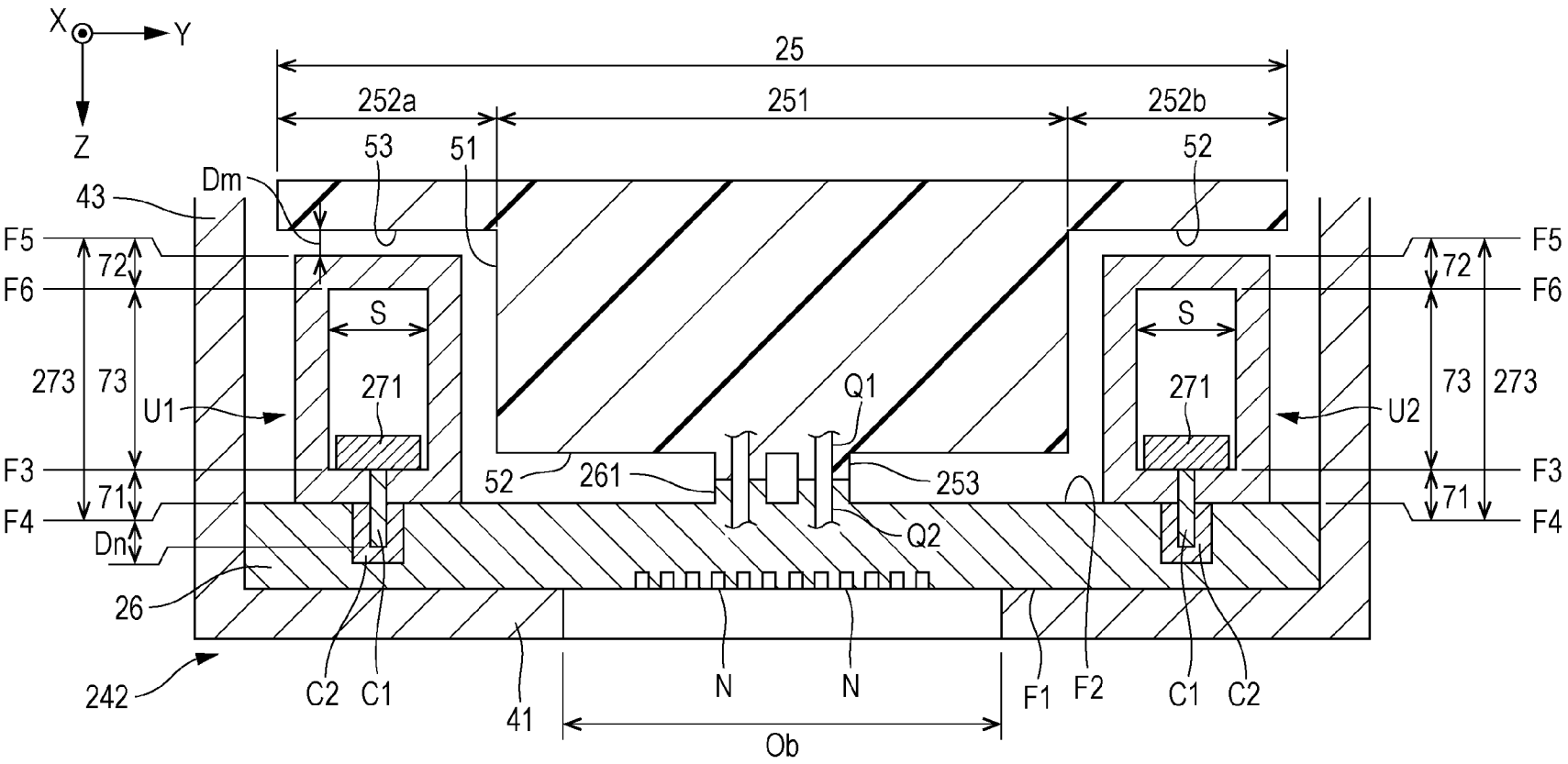
FIG. 3 is a sectional view taken along line III-III in FIG. 2.
Figure 4:
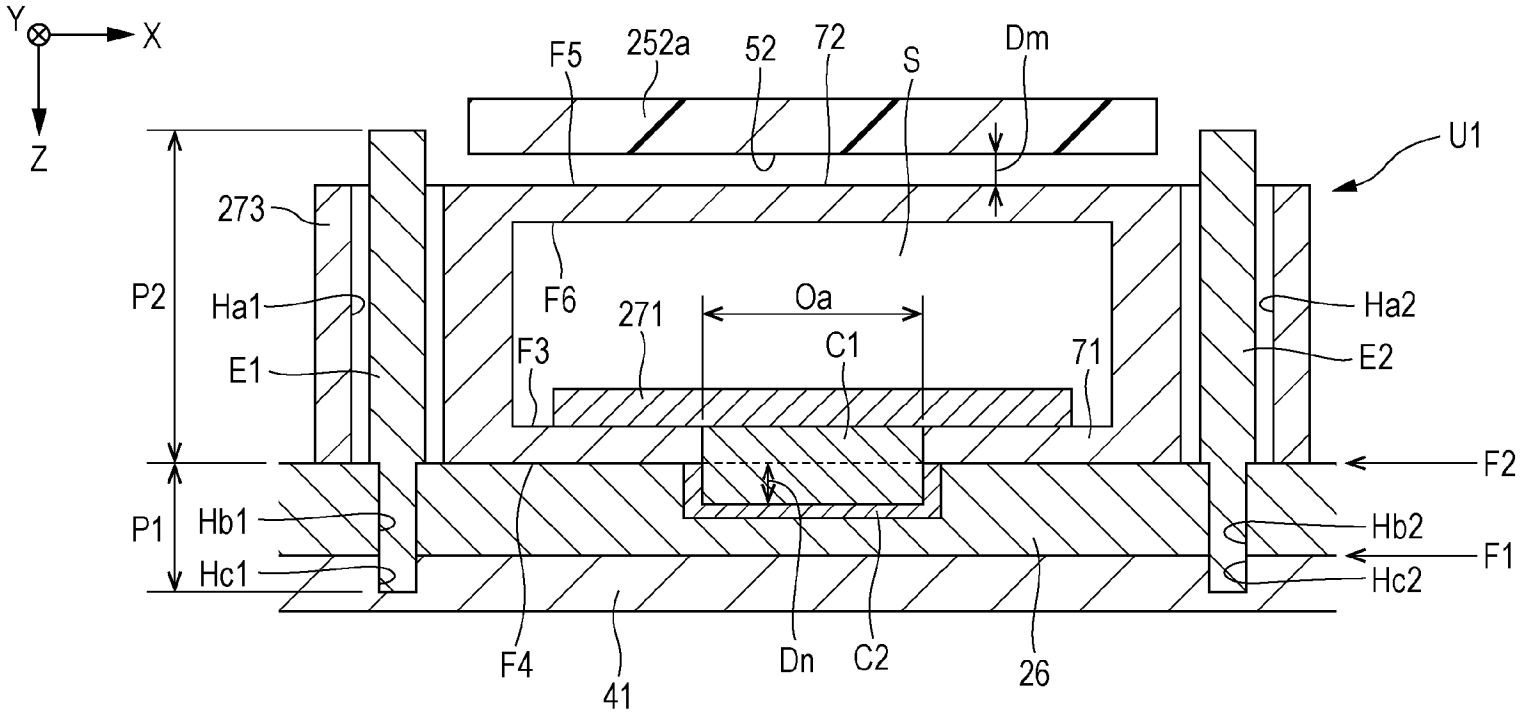
FIG. 4 is a sectional view taken along line IV-IV in FIG. 2.

FIG. 2 is a plan view of the flow channel member 25 and the liquid ejecting head 26. FIG. 3 is a sectional view taken along line III-III in FIG. 2, and FIG. 4 is a sectional view taken along line IV-IV in FIG. 2. The liquid ejecting head 26 includes a nozzle surface F1 on which a nozzle is formed and a mounting surface F2 that is opposite to the nozzle surface F1. A first electric coupling member U1, a second electric coupling member U2, and the flow channel member 25 are installed on the mounting surface F2. The first electric coupling member U1 is installed in an area of the mounting surface F2 in a negative direction of the Y axis, and the second electric coupling member U2 is installed on an area of the mounting surface F2 in a positive direction of the Y axis. The flow channel member 25 is installed between the first electric coupling member U1 and the second electric coupling member U2. A detailed configuration of the flow channel member 25 will be described below. In the following description, when it is not necessary to particularly distinguish the first electric coupling member U1 and the second electric coupling member U2 from each other, the first electric coupling member U1 and the second electric coupling member U2 are simply referred to as an "electric coupling member U".

The electric coupling member U is a mounting component for supplying a signal for ejecting the ink to the liquid ejecting head 26. As illustrated in FIGS. 3 and 4, the electric coupling member U includes a wiring substrate 271, a housing portion 273, and a first electric coupling portion C1. The wiring substrate 271 is a wiring substrate on which an electric wiring for supplying, to the liquid ejecting head 26, various signals for ejecting the ink from the nozzle is formed. The first electric coupling portion C1 is a convex connector for electrically coupling the wiring substrate 271 and the liquid ejecting head 26, and is installed on the surface of the wiring substrate 271 on the liquid ejecting head 26 side. For example, the first electric coupling portion C1 is formed in a long shape along the X axis.

The housing portion 273 is a hollow structure that stores the wiring substrate 271. In detail, the housing portion 273 includes a bottom surface portion 71, an upper surface portion 72, and side surface portions 73. The bottom surface portion 71 is a portion constituting the bottom surface of an internal space S in the housing portion 273 and is in contact with the liquid ejecting head 26. The upper surface portion 72 is a portion constituting the upper surface of the internal space S in the housing portion 273, and is located on an opposite side to the bottom surface portion 71 with the internal space S interposed therebetween. When viewed from the internal space S, the bottom surface portion 71 is located in a positive direction of the Z axis, and the upper surface portion 72 is located in a negative direction of the Z axis. The upper surface portion 72 is an example of a "protective portion". The side surface portions 73 are portions constituting the side surfaces of the internal space S in the housing portion 273, and couple the upper surface portion 72 and the bottom surface portion 71 to each other.

As illustrated in FIGS. 3 and 4, the bottom surface portion 71 includes an upper surface F3 and a bottom surface F4 that is opposite to the upper surface F3. The upper surface F3 is a surface of the bottom surface portion 71 on the internal space S side, and the bottom surface F4 is a side of the bottom surface portion 71 on an opposite side to the internal space S. The upper surface F3 is a surface of the bottom surface portion 71, which is located in the negative direction of the Z axis, and the bottom surface F4 is a surface of the bottom surface portion 71, which is located in the positive direction of the Z axis. The wiring substrate 271 is installed on the upper surface F3 of the bottom surface portion 71. As illustrated in FIG. 4, the first electric coupling portion C1 is inserted into an opening Oa that penetrates the bottom surface portion 71, so that the tip of the first electric coupling portion C1 is exposed from the opening Oa to the outside of the housing portion 273. The bottom surface of the bottom surface portion 71 is in contact with the liquid ejecting head 26.

As illustrated in FIGS. 3 and 4, the upper surface portion 72 includes an upper surface F5 and a bottom surface F6 that is opposite to the upper surface F5. The upper surface F5 is a surface of the upper surface portion 72 on an opposite side to the internal space S, and the bottom surface F6 is a side of the upper surface portion 72 on the internal space S side. The upper surface F5 is a surface of the upper surface portion 72, which is located in the negative direction of the Z axis, and the bottom surface F6 is a surface of the upper surface portion 72, which is located in the positive direction of the Z axis.

A second electric coupling portion C2 electrically coupled to the first electric coupling portion C1 is formed on the mounting surface F2 of the liquid ejecting head 26. The second electric coupling portion C2 is a concave connector for electrically coupling the wiring substrate 271 and the liquid ejecting head 26. The second electric coupling portion C2 is formed at a position corresponding to the opening Oa of the housing portion 273. For example, the second electric coupling portion C2 is formed in a long shape along the X axis. By inserting the first electric coupling portion C1 into the second electric coupling portion C2, the terminals of the first electric coupling portion C1 and the second electric coupling portion C2 are electrically coupled to each other. The first electric coupling portion C1 is inserted into the second electric coupling portion C2 in the positive direction of the Z axis. On the other hand, as the first electric coupling portion C1 is extracted from the second electric coupling portion C2 in the negative direction of the Z axis, the first electric coupling portion C1 is removed from the second electric coupling portion C2. That is, the negative direction of the Z axis is an example of a direction (hereinafter, referred to as a "removal direction") in which the first electric coupling portion C1 is removed from the second electric coupling portion C2.

As illustrated in FIGS. 2 and 3, the carriage 242 includes a holding portion 41 and a wall portion 43. The holding portion 41 is a flat member for holding the liquid ejecting head 26. The wall portion 43 is a frame-like member that protrudes from the peripheral edge of the holding portion 41 in the negative direction of the Z axis. The liquid ejecting head 26 is held on the surface of the holding portion 41 in the negative direction of the Z axis. The holding portion 41 and the electric coupling member U are located on opposite sides with the liquid ejecting head 26 interposed therebetween. An opening Ob is formed in the holding portion 41 such that the nozzle N of the liquid ejecting head 26 is exposed therethrough. The liquid ejecting head 26 and the electric coupling member U are fixed to the holding portion 41.

Hereinafter, a structure for fixing the liquid ejecting head 26 and the electric coupling member U to the holding portion 41 will be described. As illustrated in FIG. 4, a first through-hole Ha1 and a second through-hole Ha2 that penetrate the housing portion 273 along the Z axis are provided in the housing portion 273 of each electric coupling member U. In the first embodiment, the first through-hole Ha1 and the second through-hole Ha2 are formed on opposite sides with the internal space S of the housing portion 273 interposed therebetween. For example, when viewed from the internal space S, the first through-hole Ha1 is formed in a negative direction of the X axis, and the second through-hole Ha2 is formed in a positive direction of the X axis. The first electric coupling portion C1 is installed between the first through-hole Ha1 and the second through-hole Ha2. In the first embodiment, the first through-hole Ha1, the second through-hole Ha2, and the first electric coupling portion C1 are arranged in parallel to each other along the X axis. In the following description, when it is not necessary to particularly distinguish the first through-hole Ha1 and the second through-hole Ha2 from each other, the first through-hole Ha1 and the second through-hole Ha2 are simply referred to as a "through-hole Ha".

The liquid ejecting head 26 is provided with a first attachment hole Hb1 and a second attachment hole Hb2 that penetrate the liquid ejecting head 26 along the Z axis. In detail, the first attachment hole Hb1 is formed at a position corresponding to the first through-hole Ha1, and the second attachment hole Hb2 is formed at a position corresponding to the second through-hole Ha2. The first attachment hole Hb1 and the second attachment hole Hb2 are located on opposite sides with the second electric coupling portion C2 interposed therebetween. That is, the second electric coupling portion C2 is located between the first attachment hole Hb1 and the second attachment hole Hb2. In the first embodiment, the first attachment hole Hb1, the second attachment hole Hb2, and the second electric coupling portion C2 are arranged in parallel to each other along the X axis. In the following description, when it is not necessary to particularly distinguish the first attachment hole Hb1 and the second attachment hole Hb2 from each other, the first attachment hole Hb1 and the second attachment hole Hb2 are simply referred to as an "attachment hole Hb".

The holding portion 41 is provided with a first hole portion Hc1 and a second hole portion Hc2 that are bottomed holes. In detail, the first hole portion Hc1 is formed at a position corresponding to the first through-hole Ha1 and the first attachment hole Hb1, and the second hole portion Hc2 is formed at a position corresponding to the second through-hole Ha2 and the second attachment hole Hb2. In the following description, when it is not necessary to particularly distinguish the first hole portion Hc1 and the second hole portion Hc2 from each other, the first hole portion Hc1 and the second hole portion Hc2 are simply referred to as a "hole portion Hc". The through-hole Ha, the attachment hole Hb, and the hole portion Hc are formed to overlap each other in a plan view from the Z axis direction. In other words, the through-hole Ha, the attachment hole Hb, and the hole portion Hc are formed at the same position in both the X axis direction and the Y axis direction. The cross-sections of the through-hole Ha, the attachment hole Hb, and the hole portion Hc when viewed from the Z axis direction is circular.

The liquid ejecting head 26 and the electric coupling member U are fixed to the holding portion 41 by a first fixing member E1 and a second fixing member E2. The first fixing member E1 is inserted into the first through-hole Ha1, the first attachment hole Hb1, and the first hole portion Hc1. The second fixing member E2 is inserted into the second through-hole Ha2, the second attachment hole Hb2, and the second hole portion Hc2. In the following description, when it is not necessary to particularly distinguish the first fixing member E1 and the second fixing member E2 from each other, the first fixing member E1 and the second fixing member E2 are simply referred to as a "fixing member E". As understood from the above description, in the first embodiment, the liquid ejecting head 26 and the electric coupling member U are fixed to the holding portion 41 by the two fixing members E located on opposite sides with the first electric coupling portion C1 and the second electric coupling portion C2 interposed therebetween.

As illustrated in FIG. 4, the fixing member E is a cylindrical member extending along the Z axis. The fixing member E according to the first embodiment is divided into a first portion P1 and a second portion P2 along the Z axis. The first portion P1 is a portion of the fixing member E, which is located in the positive direction of the Z axis. The second portion P2 is a portion of the fixing member E, which is located in the negative direction of the Z axis.

The first portion P1 is located inside the hole portion Hc and inside the attachment hole Hb in the fixing member E. A screw is formed at a portion of the first portion P1, which is located inside the hole portion Hc. Therefore, the fixing member E is fixed to the holding portion 41 by inserting the tip of the first portion P1 into the hole portion Hc. In the first embodiment, the outer diameter of the first portion P1 and the inner diameter of the attachment hole Hb are substantially equal to each other, and the outer peripheral surface of the first portion P1 and the inner peripheral surface of the attachment hole Hb abut on each other. That is, no gap is formed between the outer peripheral surface of the first portion P1 and the inner peripheral surface of the attachment hole Hb. In the first embodiment, the liquid ejecting head 26 is supported on the holding portion 41 by fixing the fixing member E to the hole portion Hc of the holding portion 41 in a state in which the fixing member E passes through the attachment hole Hb.

Hereinafter, a detailed configuration of the flow channel member 25 will be described. As illustrated in FIGS. 2 and 3, the flow channel member 25 includes a base portion 251, a first overhang portion 252*a*, a second overhang portion 252*b*, and a first flow channel coupling portion 253. The flow channel member 25 is integrally formed, for example, by injection molding of a resin material. The base portion 251 is a portion of the flow channel member 25, which is located between the two electric coupling members U. A portion of a side surface 51 of the base portion 251 along the X axis and a portion of the side surface portion 73 of the housing portion 273 along the X axis face each other. In detail, the portion of the side surface 51 of the base portion 251 along the X axis in the negative direction of the Y axis and the portion of the side surface portion 73 of the housing portion 273 of the first electric coupling member U1 along the X axis in the positive direction of the Y axis face each other. Further, the portion of the side surface 51 of the base portion 251 along the X axis in the positive direction of the Y axis and the portion of the side surface portion 73 of the housing portion 273 of the second electric coupling member U2 along the X axis in the negative direction of the Y axis face each other. The bottom surface 52 of the base portion 251 faces the mounting surface F2 of the liquid ejecting head 26. A flow channel for supplying the ink to the liquid ejecting head 26 is formed in the base portion 251.

The first overhang portion 252*a* and the second overhang portion 252*b* are portions of the flow channel member 25, which project from side surfaces 51 of the base portion 251. As illustrated in FIG. 3, the first overhang portion 252*a* and the second overhang portion 252*b* protrude from the peripheral edges of the side surfaces 51 of the base portion 251 in the negative direction of the Z axis along the Y axis. As illustrated in FIG. 2, the first overhang portion 252*a* is formed in the peripheral edge of the base portion 251 in the negative direction of the Y axis, and the second overhang portion 252*b* is formed in the peripheral edge of the base portion 251 in the positive direction of the Y axis. That is, the first overhang portion 252*a* and the second overhang portion 252*b* are located on opposite sides with the base portion 251 interposed therebetween in the Y axis direction. As illustrated in FIGS. 2 and 3, the first overhang portion 252*a* is formed to cover the first electric coupling member U1, and the second overhang portion 252*b* is formed to cover the second electric coupling member U2. In the following description, when it is not necessary to particularly distinguish the first overhang portion 252*a* and the second overhang portion 252*b* from each other, the first overhang portion 252*a* and the second overhang portion 252*b* are simply referred to as an "overhang portion 252".

As illustrated in FIG. 3, the electric coupling member U is located between the flow channel member 25 and the liquid ejecting head 26 in the removal direction. In the first embodiment, the electric coupling member U is located between the overhang portion 252 and the liquid ejecting head 26 in the removal direction. That is, when viewed from the Z axis, the overhang portion 252 and the electric coupling member U overlap each other. In detail, the upper surface portion 72 of the housing portion 273 and the overhang portion 252 face each other. That is, the upper surface portion 72 is located between the wiring substrate 271 and the overhang portion 252. In the first embodiment, the upper surface portion 72 of the housing portion 273 is located between the first electric coupling portion C1 and the second electric coupling portion C2 and the flow channel member 25. In the example of FIG. 2, the overhang portion 252 and the housing portion 273 face each other between the first fixing member E1 and the second fixing member E2. The overhang portion 252 may be formed to cover the entire upper surface portion 72 of the housing portion 273. In the first embodiment, the overhang portion 252 and the housing portion 273 face each other over the entire width of the housing portion 273 in the Y axis direction. That is, the length of the overhang portion 252 is larger than the length of the housing portion 273 in the Y axis direction. In the first embodiment, the upper surface of the overhang portion 252 and the upper surface of the base portion 251 are continuously formed.

As illustrated in FIGS. 3 and 4, the overhang portion 252 and the electric coupling member U face each other with a gap Dm therebetween in the removal direction. A distance from the upper surface F5 of the upper surface portion 72 and a bottom surface 53 of the overhang portion 252 in the housing portion 273 is the gap Dm. The bottom surface 52 of the overhang portion 252 is a surface of the overhang portion 252 on the electric coupling member U side. The gap Dm according to the first embodiment is smaller than the length Dn (hereinafter, referred to as an "insertion length") a portion of the first electric coupling portion C1, which is inserted into the second electric coupling portion C2, in the removal direction. In other words, the insertion length Dn is a distance from the tip of the first electric coupling portion C1 to the mounting surface F2.

As illustrated in FIG. 3, the first flow channel coupling portion 253 is formed on the bottom surface 52 of the base portion 251. For example, the first flow channel coupling portion 253 is formed to protrude from the bottom surface 52 of the base portion 251. A flow channel Q1 for supplying the ink in the base portion 251 to the liquid ejecting head 26 is formed in the first flow channel coupling portion 253. On the other hand, the liquid ejecting head 26 has a second flow channel coupling portion 261 coupled to the first flow channel coupling portion 253. For example, the second flow channel coupling portion 261 is formed to protrude from the mounting surface F2. A flow channel Q2 through which the ink from the flow channel member 25 passes is formed in the second flow channel coupling portion 261. The liquid ejecting head 26 ejects the ink supplied via the second flow channel coupling portion 261. The first flow channel coupling portion 253 and the second flow channel coupling portion 261 may be omitted. That is, the bottom surface of the base portion 251 and the mounting surface F2 of the liquid ejecting head 26 are coupled to each other. The liquid ejecting head 26, the flow channel member 25, and the electric coupling member U function as a "liquid ejecting unit".

Figure 5:
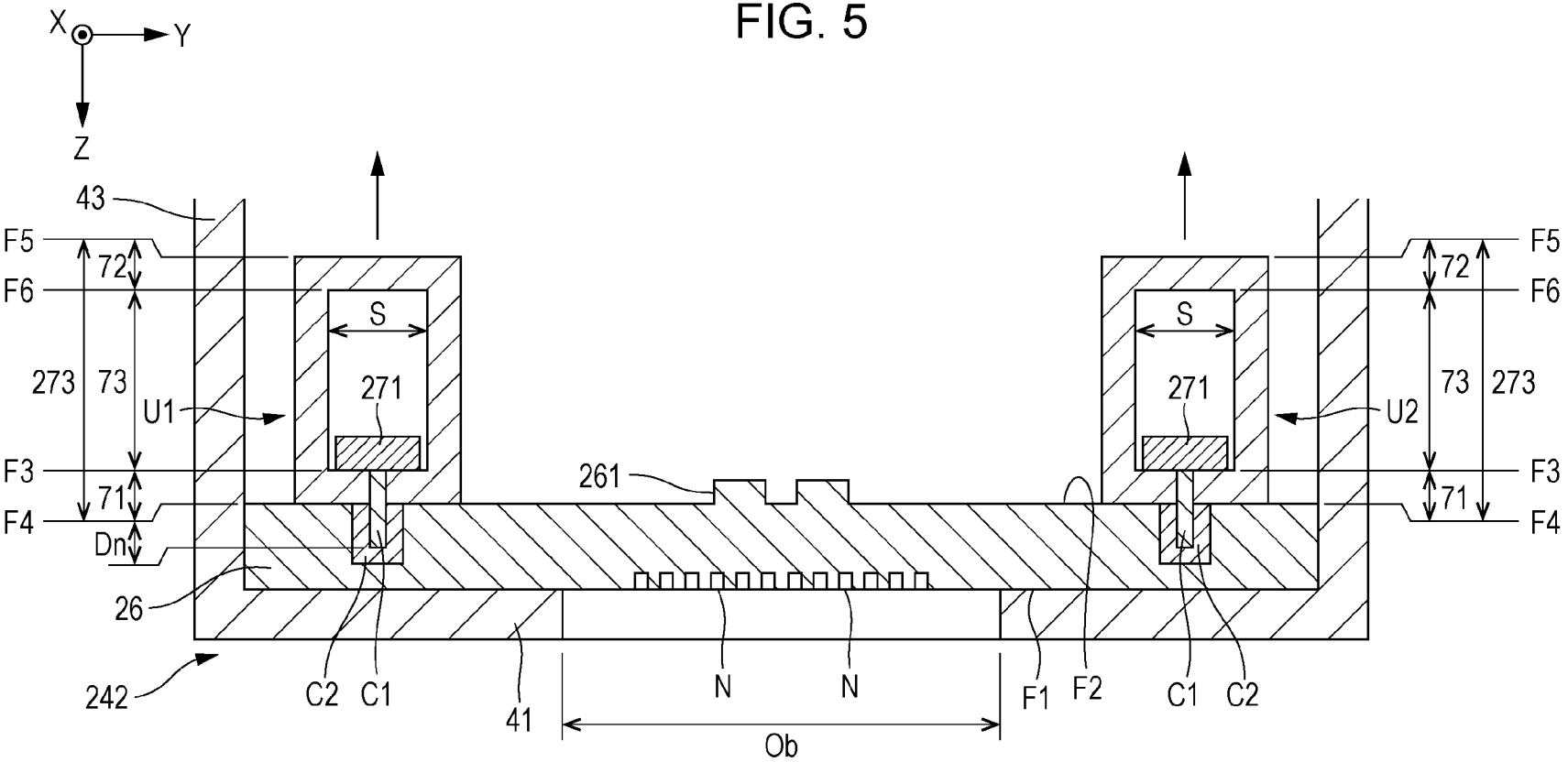
FIG. 5 is a sectional view of the liquid ejecting head after the flow channel member is removed from the liquid ejecting head.

It is assumed that the electric coupling member U and the flow channel member 25 are removed from the liquid ejecting head 26 during maintenance or inspection of the liquid ejecting unit. FIG. 5 is a diagram for illustrating an operation of removing the electric coupling member U from the liquid ejecting head 26 according to the first embodiment. In the first embodiment, as illustrated in FIG. 3, the flow channel member 25 is located in the removal direction of the electric coupling member U. Therefore, as illustrated in FIG. 5, unless the flow channel member 25 is removed from the liquid ejecting head 26, the electric coupling member U cannot be removed. That is, in a state in which the flow channel member 25 and the liquid ejecting head 26 are coupled to each other, the coupling between the first electric coupling portion C1 and the second electric coupling portion C2 cannot be released. After the flow channel member 25 is removed, as illustrated in FIG. 5, the electric coupling member U moves in the removal direction, so that the electric coupling member U can be removed from the liquid ejecting head 26. As understood from the above description, the flow channel member 25 functions as an element that restricts the electric coupling member U from moving in the removal direction. When the flow channel member 25 and the electric coupling member U are attached to the liquid ejecting head 26, the flow channel member 25 is attached after the electric coupling member U is attached.

Here, when the flow channel member 25 is removed from the liquid ejecting head 26, the ink may drip from the flow channel member 25 and adhere to the surroundings. A configuration (hereinafter, referred to as a "comparative example") is assumed in which in a state in which the flow channel member 25 is attached to the liquid ejecting head 26, the coupling between the first electric coupling portion C1 and the second electric coupling portion C2 can be released. The comparative example corresponds to, for example, a configuration in which the flow channel member 25 is not located in the removal direction of the electric coupling member U. The flow channel member 25 according to the comparative example does not restrict the electric coupling member U from moving in the removal direction. Therefore, before the flow channel member 25 is removed from the liquid ejecting head 26, the electric coupling member U can be removed. That is, after the electric coupling member U is removed from the liquid ejecting head 26, the flow channel member 25 may be removed. Therefore, there is a possibility that the ink dripping from the flow channel member 25 adheres to the second electric coupling portion C2 that is exposed after the coupling between the first electric coupling portion C1 and the second electric coupling portion C2 is released.

On the other hand, according to the configuration of the first embodiment in which the electric coupling member U from moving in the removal direction is restricted, as described above, the coupling between the first electric coupling portion C1 and the second electric coupling portion C2 cannot be released unless the electric coupling member U is removed from the liquid ejecting head 26. That is, in a state in which the second electric coupling portion C2 is exposed, the electric coupling member U cannot be removed from the liquid ejecting head 26. Therefore, when the flow channel member 25 is removed from the liquid ejecting head 26, the ink can be prevented from adhering to the second electric coupling portion C2.

In the first embodiment, the flow channel member 25, the liquid ejecting head 26, and the electric coupling member U are arranged such that the electric coupling member U is located between the flow channel member 25 and the liquid ejecting head 26 in the removal direction. Thus, the configuration can be easily implemented which restricts the electric coupling member U from moving in the removal direction. In particular, in the first embodiment, since the electric coupling member U is located between the overhang portion 252 and the liquid ejecting head 26 in the flow channel member 25, the flow channel member 25 is easily attached to or detached from the liquid ejecting head 26 while grasping the overhang portion 252.

Further, according to the configuration of the first embodiment in which the electric coupling member U has the upper surface portion 72 located between the wiring substrate 271 and the overhang portion 252, when the flow channel member 25 is removed from the liquid ejecting head 26, the ink can be prevented from adhering to the wiring substrate 271. In the first embodiment, since the upper surface portion 72 of the housing portion 273 is located between the first electric coupling portion C1 and the second electric coupling portion C2 and the overhang portion 252, the ink can be certainly prevented from adhering to the first electric coupling portion C1 and the second electric coupling portion C2.

In the first embodiment, in the first embodiment, since the gap Dm is smaller than the insertion length Dn, it is possible to reliably prevent the electric coupling member U from being removed from the liquid ejecting head 26 before the flow channel member 25 is removed from the liquid ejecting head 26. However, the gap Dm may be larger than the insertion length Dn. For example, even when the gap Dm is slightly larger than the insertion length Dn, if it is difficult to release the coupling between the first electric coupling portion C1 and the second electric coupling portion C2 before the flow channel member 25 is removed, the effect is implemented in which, when the flow channel member 25 is removed from the liquid ejecting head 26, it is possible to prevent the ink from adhering to the second electric coupling portion C2.

B. Second Embodiment

A second embodiment will be described below. In the following examples, an element having the same function as that of the first embodiment is designated by the same reference numeral used in the description of the first embodiment, and detailed description thereof will be omitted as appropriate.

Figure 6:
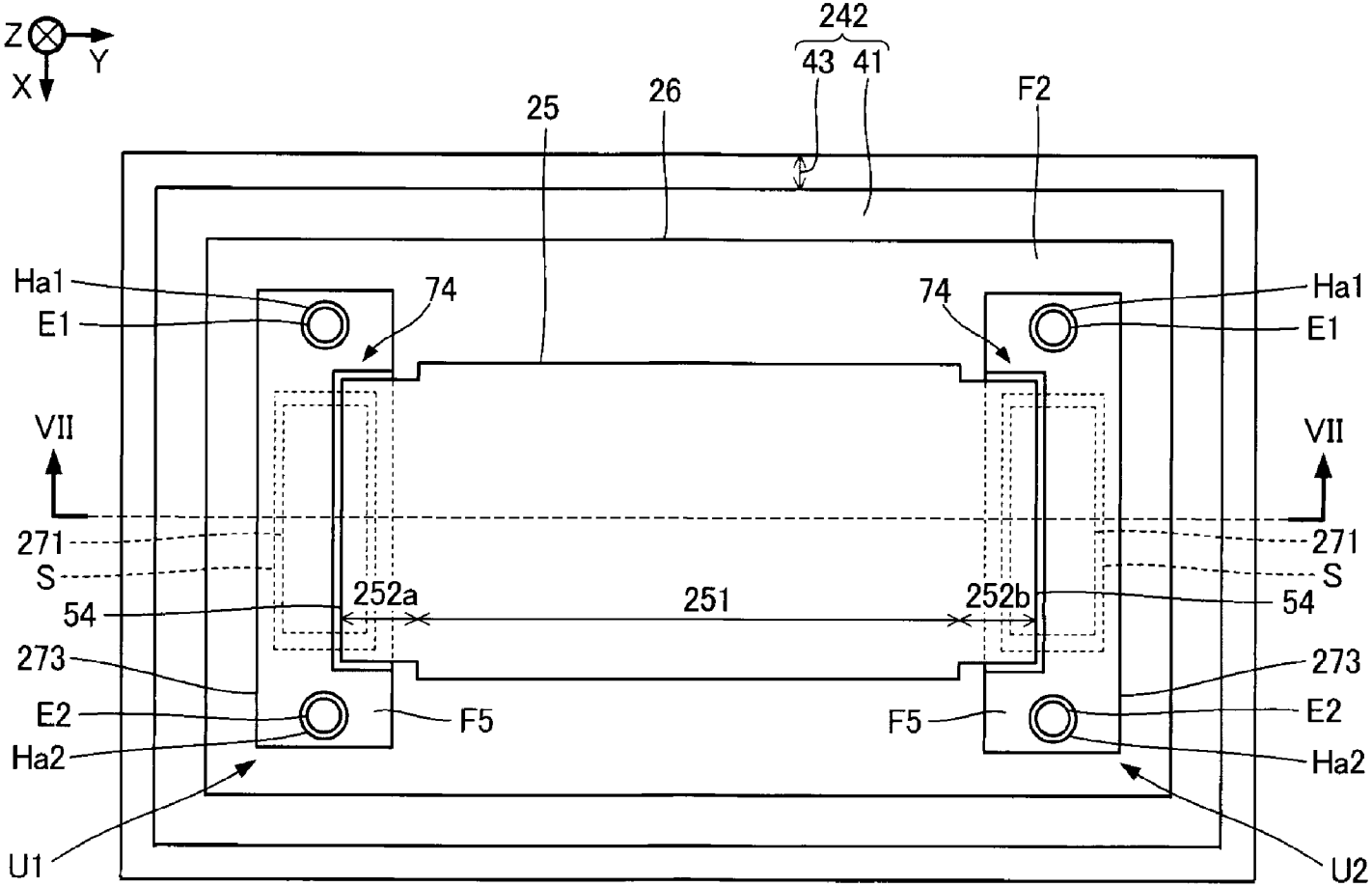
FIG. 6 is a plan view of a liquid ejecting unit according to a second embodiment.
Figure 7:
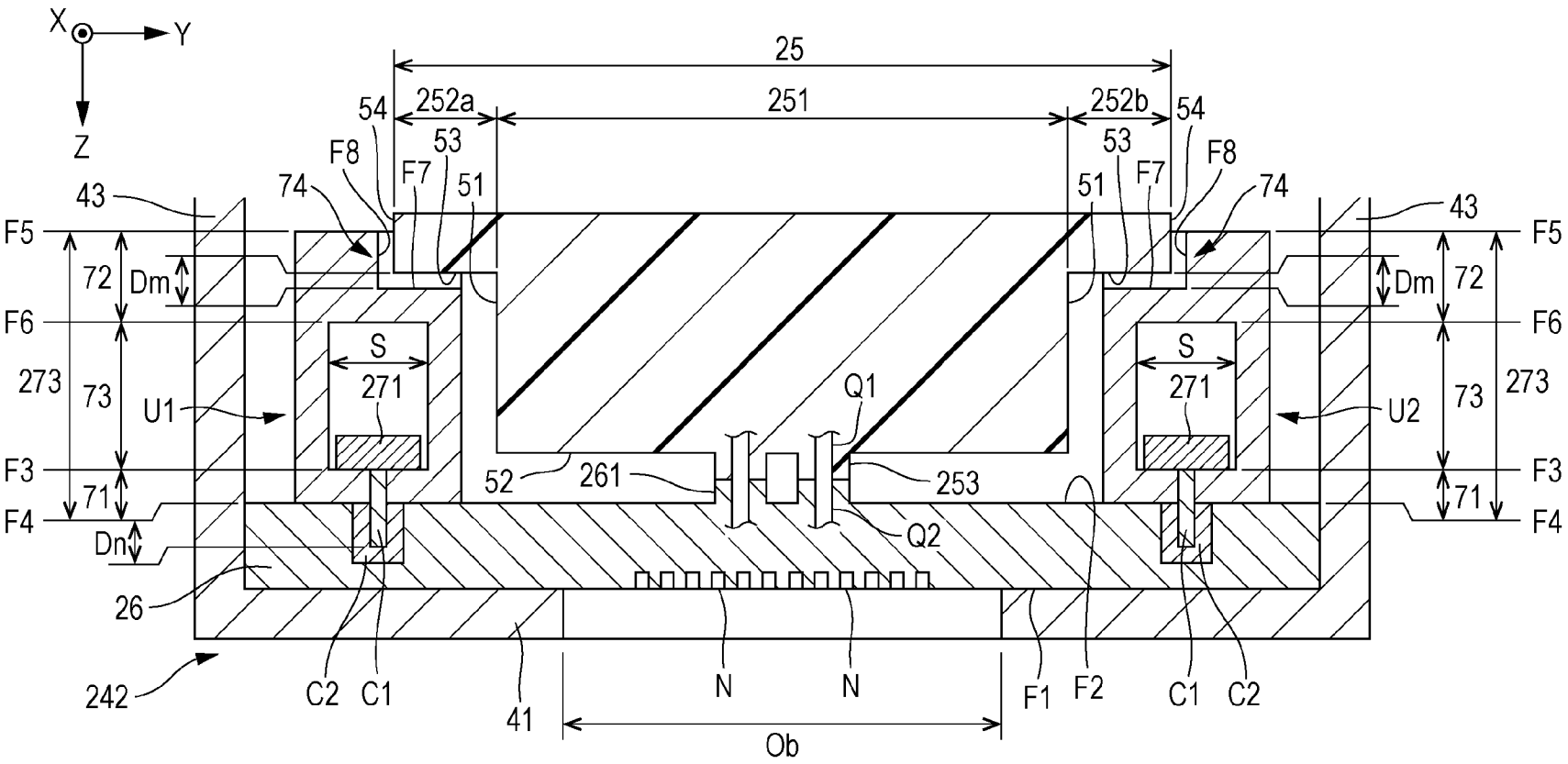
FIG. 7 is a sectional view taken along line VII-VII in FIG. 5.
Figure 8:
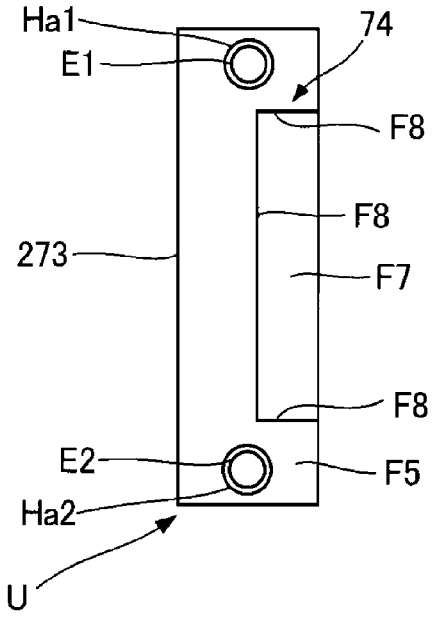
FIG. 8 is a plan view of an electric coupling member.

FIG. 6 is a plan view of a liquid ejecting unit according to the second embodiment, and FIG. 7 is a sectional view taken along line VII-VII in FIG. 6. FIG. 8 is a plan view of an electric coupling member U according to the second embodiment. As illustrated in FIGS. 6 to 8, the shape of the housing portion 273 in the electric coupling member U according to the second embodiment is different from that according to the first embodiment. A notch portion 74 that is recessed with respect to the upper surface F5 is formed on the upper surface portion 72 of the housing portion 273 according to the second embodiment. The notch portion 74 is formed at a peripheral edge of the upper surface F5 of the upper surface portion 72 on the base portion 251 side along the X axis. That is, in the first electric coupling member U1, the notch portion 74 is formed at a peripheral edge of the upper surface F5 of the upper surface portion 72 in the positive direction of the Y axis along the X axis, and in the second electric coupling member U2, the notch portion 74 is formed at a peripheral edge of the upper surface F5 of the upper surface portion 72 in the negative direction of the Y axis along the X axis. The notch portion 74 is formed at a part of the peripheral edge of the upper surface F5 of the upper surface portion 72 along the X axis. As illustrated in FIG. 8, the inner surface of the notch portion 74 is configured with a bottom surface F7 and side surfaces F8. The side surfaces F8 of the notch portion 74 include a wall surface along the Y axis and a wall surface along the X axis. The bottom surface F7 of the notch portion 74 is an example of a "first surface", and the side surfaces F8 of the notch portion 74 are examples of "second surfaces".

As illustrated in FIG. 6, the overhang portion 252 of the flow channel member 25 according to the second embodiment is formed to correspond to the notch portion 74 of the housing portion 273. As illustrated in FIG. 7, the flow channel member 25 is attached to the liquid ejecting head 26 such that the overhang portion 252 is stored on the inner surface of the notch portion 74. The entire overhang portion 252 may not be stored on the inner surface of the notch portion 74. As illustrated in FIGS. 7 and 8, at least an end portion of the overhang portion 252 may be stored on the inner surface of the notch portion 74. The bottom surface F7 of the notch portion 74 faces the bottom surface 53 of the overhang portion 252 and abuts on the bottom surface 53. The side surfaces F8 of the notch portion 74 face side surfaces 54 of the overhang portion 252 with a gap interposed therebetween. However, the side surfaces F8 of the notch portion 74 may abut on the side surfaces 54 of the overhang portion 252. The side surfaces 54 of the overhang portion 252 along the X axis face the side surfaces F8 of the notch portion 74 along the X axis. The side surfaces 54 of the overhang portion 252 in the positive direction of the X axis along the Y axis face the side surfaces F8 of the notch portion 74 in the positive direction of the X axis along the Y axis. The side surfaces 54 of the overhang portion 252 in the negative direction of the X axis along the Y axis face the side surfaces F8 of the notch portion 74 in the negative direction of the X axis along the Y axis. The length of the notch portion 74 in the X axis direction is larger than the length of the overhang portion 252 in the X axis direction. The length of the notch portion 74 in the Z axis direction may be smaller than or larger than the length of the overhang portion 252 in the Z axis direction.

Similar to the first embodiment, the overhang portion 252 and the electric coupling member U face each other with the gap Dm therebetween in the removal direction. The gap Dm according to the second embodiment is a distance between the bottom surface F7 of the notch portion 74 and the bottom surface 53 of the overhang portion 252.

As understood from the above description, since the flow channel member 25 is located above the electric coupling member U even in the second embodiment, the electric coupling member U can be restricted from moving in the removal direction. In particular, in the second embodiment, the bottom surface 53 and the side surfaces 54 of the overhang portion 252 face the inner surface of the notch portion 74 formed in the housing portion 273. The position of the overhang portion 252 is aligned with the notch portion 74, so that the flow channel member 25 can be easily attached to the liquid ejecting head 26. That is, in the operation of attaching the flow channel member 25 to the liquid ejecting head 26, the notch portion 74 of the housing portion 273 can be used as a rough guide for positioning the flow channel member 25. In detail, since the notch portion 74 has the side surfaces F8 that face the side surfaces 54 of the overhang portion 252 and guides the side surfaces 54, the positioning of the overhang portion 252 in the X-Y plane is prepared. Further, since the notch portion 74 has the bottom surface F7 that faces the bottom surface 53 of the overhang portion 252 and abuts on and supports the bottom surface 53 of the overhang portion 252, the positioning of the overhang portion 252 in the Z axis direction is prepared. In the second embodiment, a configuration is illustrated in which both the side surfaces F8 for guiding the side surfaces 54 to the flow channel member 25 and the bottom surface F7 for supporting the bottom surface 53 are provided. However, a configuration is also employed in which only one of the side surfaces F8 and the bottom surface F7 is provided. For example, although the notch portion 74 is provided with a surface that abuts and supports the bottom surface 53, a configuration may be employed in which only a surface spaced apart from the side surfaces 54 is provided at a position facing the side surfaces 54, and does not have a function of guiding the side surfaces 54. That is, the inner surface of the notch portion 74 and the surface of the overhang portion 252 may face each other with a gap therebetween.

C. Modification Example

Each embodiment illustrated above can be variously modified. Detailed modifications that can be applied to the above-described embodiments will be described as an example below. Two or more aspects selected from the following examples in a predetermined manner can be appropriately combined as long as the aspects do not contradict each other.

Figure 9:
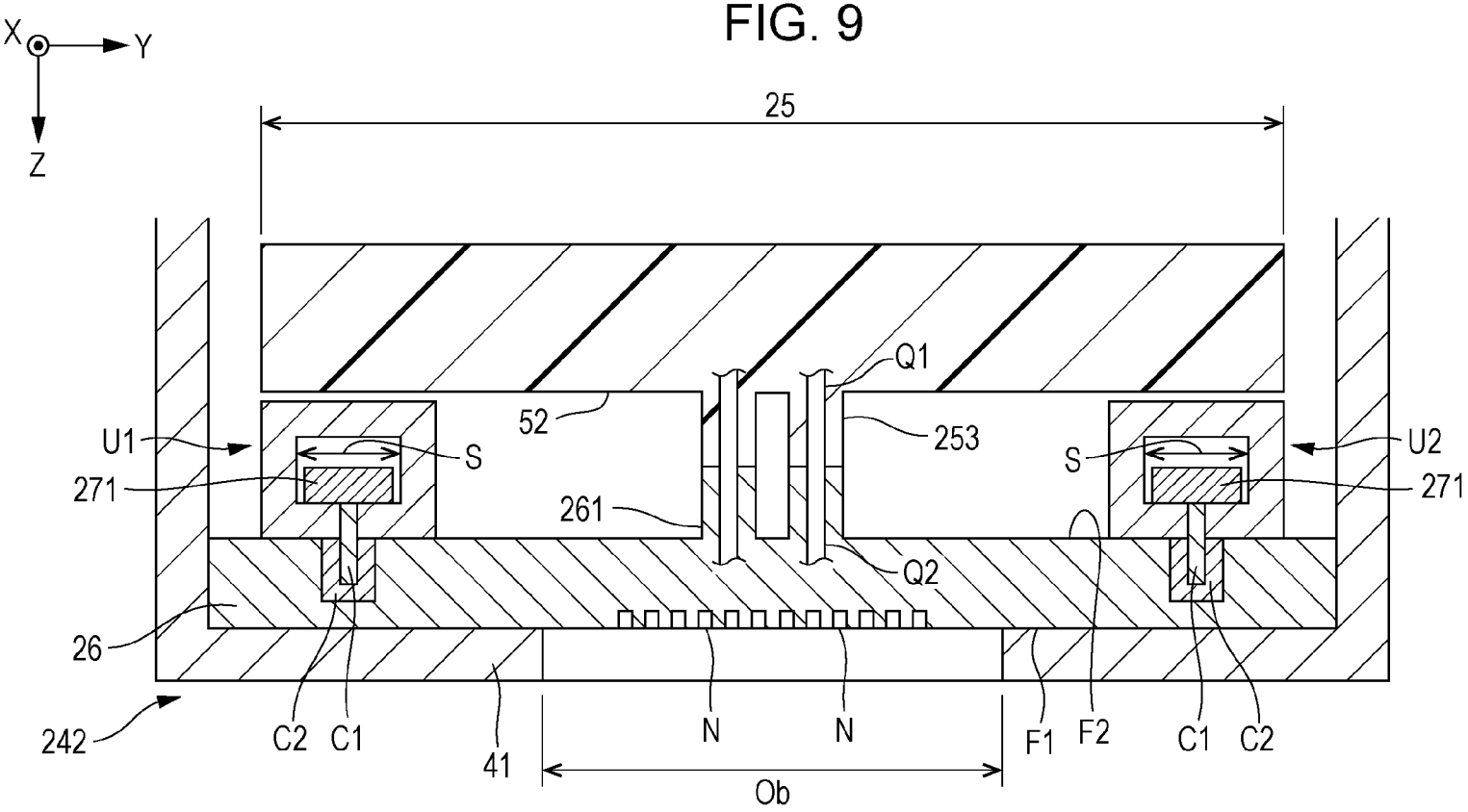
FIG. 9 is a sectional view of a liquid ejecting unit according to a modification example.

(1) In the above-described embodiments, the flow channel member 25 is configured with the base portion 251, the overhang portion 252, and the first flow channel coupling portion 253. However, the configuration of the flow channel member 25 is not limited to the above examples. For example, as illustrated in FIG. 9, the overhang portion 252 may be omitted. That is, the flow channel member 25 may be configured with the base portion 251 and the first flow channel coupling portion 253 that extend along the Y axis. An end portion of the base portion 251 in the negative direction of the Y axis overlaps the first electric coupling member U1, and an end portion of the base portion 251 in the positive direction of the Y axis overlaps the second electric coupling member U2.

(2) In the first embodiment, the configuration is illustrated in which the flow channel member 25 faces the housing portion 273 over the entire width of the housing portion 273 in the Y axis direction. However, a configuration is also employed in which the flow channel member 25 faces the housing portion 273 in a part of the housing portion 273 in the Y axis direction. The shape of the flow channel member 25 is predetermined as long as the electric coupling member U can be restricted from moving in the removal direction. As understood from the above description, a configuration is employed in which at least a part of the flow channel member 25 overlaps the electric coupling member U in a plan view (the X-Y plane) from the Z direction.

Figure 10:
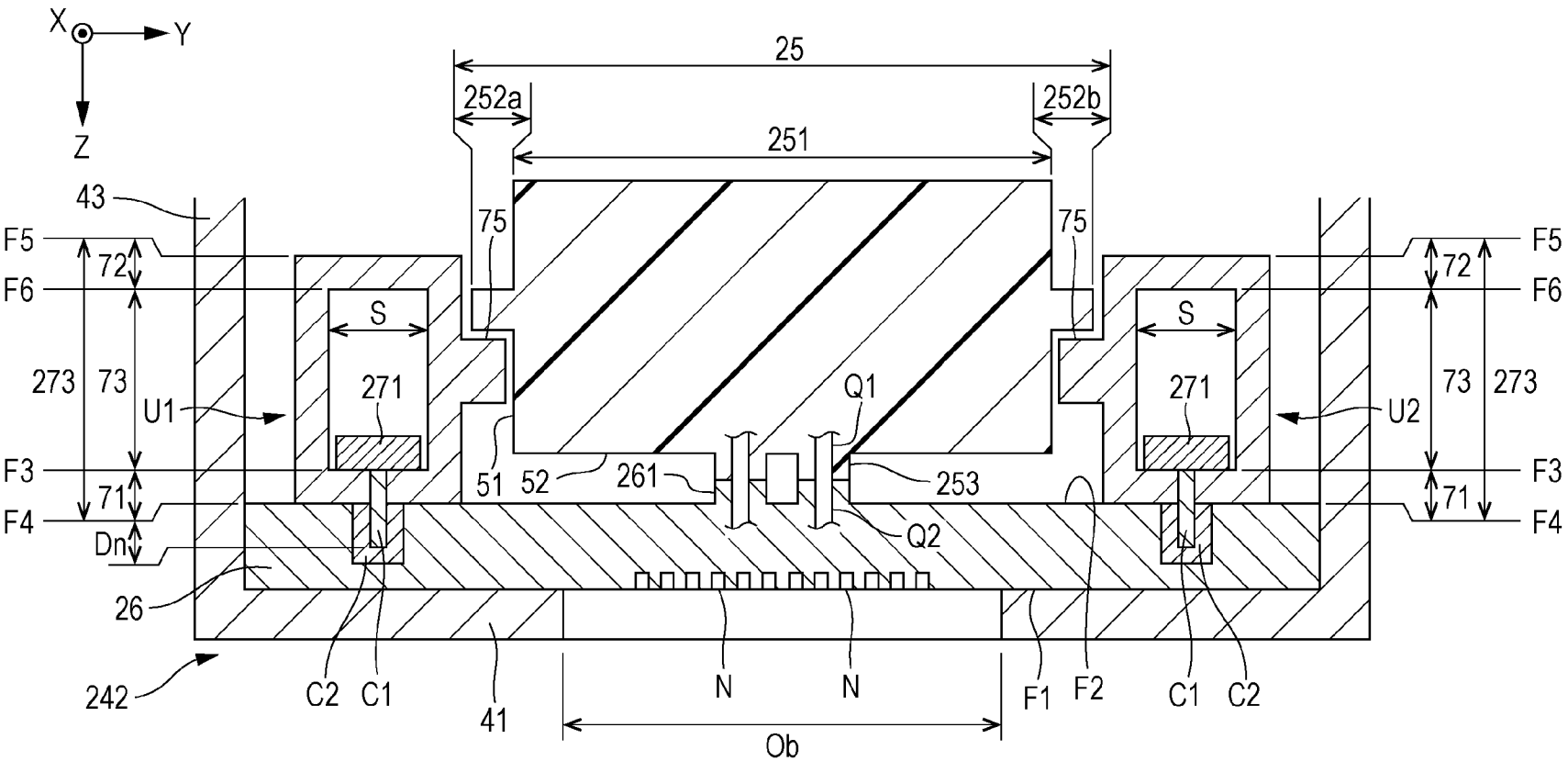
FIG. 10 is a sectional view of a liquid ejecting unit according to a modification example.

(3) In the above-described embodiments, the housing portion 273 includes the upper surface portion 72, the bottom surface portion 71, and the side surface portions 73. However, the configuration of the housing portion 273 is not limited to the above examples. The housing portion 273 may include a portion different from the upper surface portion 72, the bottom surface portion 71, and the side surface portions 73. Further, a portion of the housing portion 273, which overlaps the flow channel member 25, is not limited to the upper surface portion 72 of the housing portion 273. For example, as illustrated in FIG. 10, the flow channel member 25 may be located above protrusion portions 75 that protrude from the side surface portions 73.

(4) In the above-described embodiments, the electric coupling member U includes the housing portion 273. However, the housing portion 273 may be omitted. That is, an element that is different from the housing portion 273 may be located below the flow channel member 25 in the electric coupling member U. For example, the flow channel member 25 may be located above the wiring substrate 271 in the electric coupling member U. The electric coupling member U may include a member that is different from the wiring substrate 271 and the housing portion 273.

(5) In the above-described embodiments, the overhang portion 252 is formed in the peripheral edge on the side surface of the base portion 251 in the negative direction of the Z axis. However, the position where the overhang portion 252 is formed is not limited to the above examples. The overhang portion 252 is formed in a predetermined position on the side surface of the base portion 251 in the Z axis direction. As illustrated in FIG. 10, the overhang portion 252 is formed at a position corresponding to the shape of the electric coupling member U or the flow channel member 25.

(6) In the above-described embodiments, the bottom surface of the overhang portion 252 and the electric member face each other with the gap D therebetween. However, the bottom surface of the overhang portion 252 and the electric member may abut each other.

(7) In the above-described embodiments, the upper surface portion 72 of the housing portion 273 is located between the wiring substrate 271 and the flow channel member 25 in the removal direction. However, a member for protecting the wiring substrate 271 may be disposed between the wiring substrate 271 and the flow channel member 25 instead of the housing portion 273. The member is an example of a "protective portion".

Figure 11:
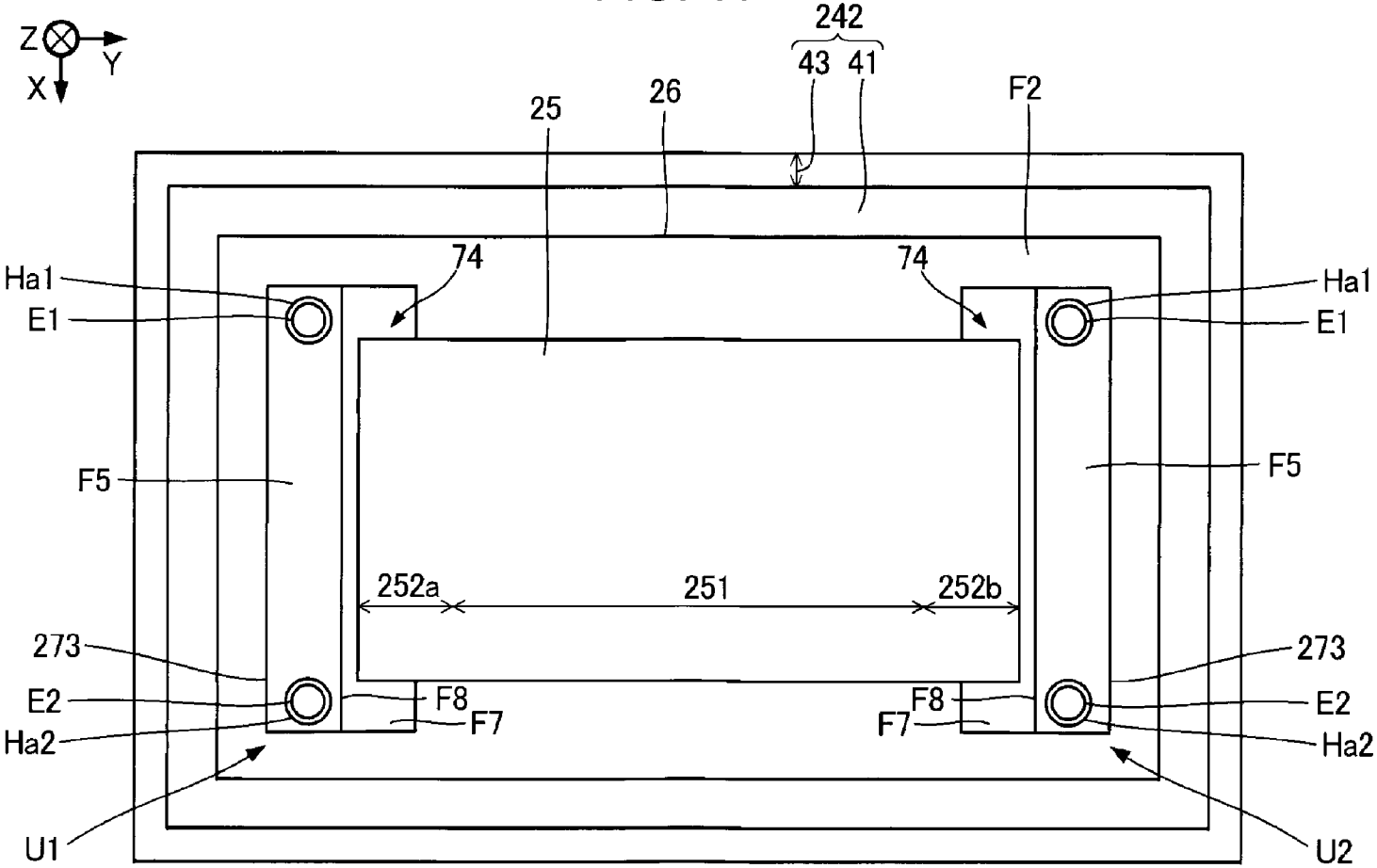
FIG. 11 is a plan view of a liquid ejecting unit according to a modification example.
Figure 12:
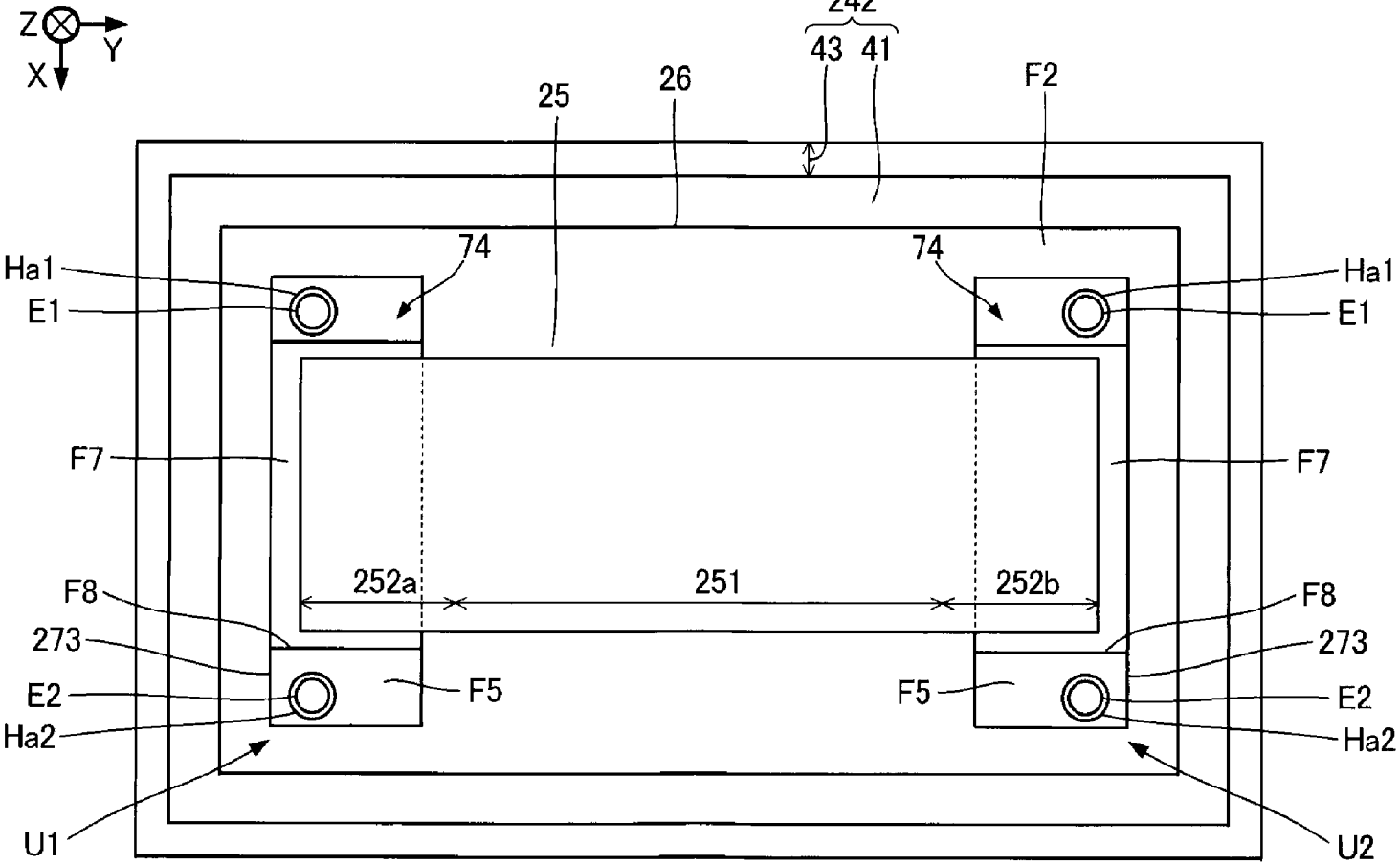
FIG. 12 is a plan view of a liquid ejecting unit according to a modification example.

(8) In the second embodiment, the shape of the notch portion 74 is predetermined. For example, as illustrated in FIG. 11, the notch portion 74 may be formed over the entire width of the upper surface portion 72 in the X axis direction. Further, as illustrated in FIG. 12, the notch portion 74 may be formed over the entire width of the upper surface portion 72 in the Y axis direction.

(9) In the above-described embodiments, the configuration is illustrated in which the number of the electric coupling members U included in the liquid ejecting unit is two. However, the number of the electric coupling members U included in the liquid ejecting unit is predetermined. The overhang portion 252 is formed according to the position of the electric coupling member U installed in the liquid ejecting head 26.

(10) In the above-described embodiments, the liquid ejecting head 26 and the electric coupling member U are fixed to the holding portion 41 using the fixing member E. However, a method of fixing the liquid ejecting head 26 and the electric coupling member U to the holding portion 41 is predetermined.

(11) In the above-described embodiments, the flow channel for supplying the ink to the liquid ejecting head 26 is formed in the base portion 251 of the flow channel member 25. However, the flow channel may be formed in the overhang portion 252.

(12) In the above-described embodiments, another element may be interposed between the flow channel member 25 and the electric coupling member U.

(13) In the above-described embodiments, the negative direction of the Z axis is illustrated as the removal direction of the electric coupling member U. However, the removal direction is changed in a predetermined manner according to the position where the electric coupling member U is attached to the liquid ejecting head 26.

(14) In the above-described embodiments, the configuration is illustrated in which the first electric coupling portion C1 is a convex connector and the second electric coupling portion C2 is a concave connector. However, the first electric coupling portion C1 may be a concave connector and the second electric coupling portion C2 may be a convex connector. That is, the first electric coupling portion C1 and the second electric coupling portion C2 are coupled to each other by inserting one thereof into the other thereof. Further, in the above-described embodiments, the first electric coupling portion C1 and the second electric coupling portion C2 that are long are illustrated. However, the shapes of the first electric coupling portion C1 and the second electric coupling portion C2 are predetermined.

(15) In the above-described embodiments, the liquid ejecting head 26 and the electric coupling member U are fixed to the holding portion 41 using the two fixing members E. However, the number of the fixing members E for fixing the liquid ejecting head 26 and the electric coupling member U to the holding portion 41 is predetermined.

(16) In the above-described embodiments, the electric coupling member U having the wiring substrate 271 and the housing portion 273 is illustrated. However, the configuration of the electric coupling member U is not limited to the above examples. For example, a configuration in which the electric coupling member U includes a member that is different from the wiring substrate 271 and the housing portion 273 or a configuration in which the electric coupling member U has only the wiring substrate 271 without the housing portion 273 is also employed.

(17) In the above-described embodiments, a serial type liquid ejecting apparatus 100 is illustrated which causes the carriage 242, on which the liquid ejecting head 26 is mounted, to reciprocate. However, the present disclosure can be applied to a line-type liquid ejecting apparatus in which the plurality of nozzles N are distributed over the entire width of the medium 12.

(18) The liquid ejecting apparatus 100 illustrated in the above-described embodiments may be adopted for various apparatuses such as a facsimile apparatus and a copying machine in addition to equipment dedicated to printing. However, usage of the liquid ejecting apparatus of the present disclosure is not limited to printing. For example, the liquid ejecting apparatus that ejects a solution of a color material is used as a manufacturing apparatus that forms a color filter of a liquid crystal display device. Further, a liquid ejecting apparatus that ejects a solution of a conductive material is used as a manufacturing apparatus that forms a wiring and an electrode of a wiring substrate.

What is claimed is:

1. A liquid ejecting unit comprising:
- a liquid ejecting head configured to eject a liquid;
- a flow channel member configured to be attached to and removed from the liquid ejecting head and to supply the liquid to the liquid ejecting head; and
- an electric coupling member configured to be attached to and removed from the liquid ejecting head and to supply a signal to the liquid ejecting head, wherein:
- the electric coupling member has a first electric coupling portion,
- the liquid ejecting head has a second electric coupling portion electrically coupled to the first electric coupling portion,
- the flow channel member restricts the electric coupling member from moving in a first direction in which the first electric coupling portion is removed from the second electric coupling portion,
- the flow channel member has a base portion and an overhang portion,
- the overhang portion projects from a side surface of the base portion in a second direction intersecting the first direction, overlapping the electric coupling portion when viewed in the first direction to restrict the electric coupling member from being removed from the liquid ejecting head in the first direction,
- the base member is next to the electric coupling member in the second direction, and
- the electric coupling member is located between the overhang portion and the liquid ejecting head in the first direction.

2. The liquid ejecting unit according to claim 1, wherein the base portion includes a flow channel configured to supply the liquid to the liquid ejecting head.

3. The liquid ejecting unit according to claim 1, wherein the electric coupling member has a first surface for supporting a bottom surface of the overhang portion.

4. The liquid ejecting unit according to claim 1, wherein the electric coupling member has a second surface for guiding a side surface of the overhang portion.

5. The liquid ejecting unit according to claim 1, wherein the electric coupling member has a wiring substrate including the first electric coupling portion and a protective portion located between the wiring substrate and the overhang portion in the first direction.

6. The liquid ejecting unit according to claim 5, wherein the protective portion is located between the first and second electric coupling portions and the overhang portion in the first direction.

7. The liquid ejecting unit according to claim 1, wherein the flow channel member has a first flow channel coupling portion, the liquid ejecting head has a second flow channel coupling portion coupled to the first flow channel coupling portion for supplying the liquid from the flow channel member, and the overhang portion restricts the electric coupling member from moving in the first direction in a state in which the first flow channel coupling portion and the second flow channel coupling portion are coupled to each other.

8. The liquid ejecting unit according to claim 1, wherein the first electric coupling portion and the second electric coupling portion are coupled to each other by inserting one of the first electric coupling portion and the second electric coupling portion into the other one thereof, and a gap between the overhang portion and the electric coupling member is smaller than a length of an inserted part in the first direction.

9. The liquid ejecting unit according to claim 1, wherein coupling between the first electric coupling portion and the second electric coupling portion is not released in a state in which the flow channel member and the liquid ejecting head are coupled to each other.

10. A liquid ejecting apparatus comprising:

the liquid ejecting unit according to claim 9; and a holding portion holding the liquid ejecting unit.

11. A liquid ejecting apparatus comprising:

the liquid ejecting unit according to claim 1; and a holding portion holding the liquid ejecting unit.

12. The liquid ejecting unit according to claim 1, wherein one of the first electric coupling portion and the second electric coupling portion is a convex connector, and the other of the first electric coupling portion and the second electric coupling portion is a concave connector.

13. The liquid ejecting unit according to claim 1, wherein the flow channel member has a first flow channel coupling portion, the liquid ejecting head has a second flow channel coupling portion coupled to the first flow channel coupling portion for supplying the liquid from the flow channel member, the liquid ejecting head has a nozzle surface and a mounting surface that is opposite from the nozzle surface, and the second flow channel portion and the second electric coupling portion are located on the mounting surface.

14. A liquid ejecting unit comprising:

a liquid ejecting head configured to eject a liquid;

a flow channel member that is attached to the liquid ejecting head and that supplies the liquid to the liquid ejecting head; and an electric coupling member configured to supply a signal to the liquid ejecting head, wherein the electric coupling member has a first electric coupling portion, the liquid ejecting head has a second electric coupling portion electrically coupled to the first electric coupling portion, the flow channel member restricts the electric coupling member from moving in a direction in which the first electric coupling portion is removed from the second electric coupling portion, the flow channel member has a base portion and an overhang portion, the base portion includes a flow channel configured to supply the liquid to the liquid ejecting head, the overhang portion projects from a side surface of the base portion, the electric coupling member is located between the overhang portion and the liquid ejecting head in the direction, and the electric coupling member has a first surface for supporting a bottom surface of the overhang portion.

15. A liquid ejecting unit comprising:

a liquid ejecting head configured to eject a liquid;

a flow channel member that is attached to the liquid ejecting head and that supplies the liquid to the liquid ejecting head; and an electric coupling member configured to supply a signal to the liquid ejecting head, wherein the electric coupling member has a first electric coupling portion, the liquid ejecting head has a second electric coupling portion electrically coupled to the first electric coupling portion, the flow channel member restricts the electric coupling member from moving in a direction in which the first electric coupling portion is removed from the second electric coupling portion, the flow channel member has a base portion and an overhang portion, the base portion includes a flow channel configured to supply the liquid to the liquid ejecting head, the overhang portion projects from a side surface of the base portion, the electric coupling member is located between the overhang portion and the liquid ejecting head in the direction, and the electric coupling member has a second surface for guiding a side surface of the overhang portion.

* * * * *